US006676575B1

(12) United States Patent
Mayo

(10) Patent No.: US 6,676,575 B1
(45) Date of Patent: Jan. 13, 2004

(54) WEIGHT SUPPORT FOR ABDOMINAL EXERCISES

(76) Inventor: Bradley Mayo, 12 Squire La., Bellingham, MA (US) 02019

( * ) Notice: Subject to any disclaimer, the term of this patent is extended or adjusted under 35 U.S.C. 154(b) by 256 days.

(21) Appl. No.: 09/941,214

(22) Filed: Aug. 28, 2001

Related U.S. Application Data

(60) Provisional application No. 60/228,298, filed on Aug. 28, 2000.

(51) Int. Cl.[7] ..... A63B 21/078

(52) U.S. Cl. ..... 482/104; 482/105; 482/140; 482/148

(58) Field of Search ..... 482/148, 142, 482/104, 105, 106, 107, 108, 140

(56) References Cited

U.S. PATENT DOCUMENTS 4,168,060 A * 9/1979 Hohenfeldt ..... 272/94
4,213,605 A 7/1980 McPeak
4,722,524 A 2/1988 Waszkelewicz
4,775,148 A 10/1988 McLaughlin
5,058,886 A 10/1991 Jackson
5,106,079 A * 4/1992 Escobedo et al. ..... 482/97
5,401,228 A 3/1995 McLaughlin
5,709,634 A * 1/1998 Pointer ..... 482/105
5,897,468 A 4/1999 Lumpkin
5,933,874 A 8/1999 Randolph

* cited by examiner

*Primary Examiner*—Nicholas D. Lucchesi
*Assistant Examiner*—L. Amerson
(74) *Attorney, Agent, or Firm*—Altman & Martin

(57) ABSTRACT

An apparatus for supporting a weight on a supine person's abdomen for performing abdominal exercises, including a base and a platform removably resting on the base. The platform has at least one depression for receiving a curl barbell, a straight barbell, and/or dumbbells. Optionally, pegs may extend from the platform surface for maintaining the position of a stack of disc weights laid on top of the platform. Optionally, the platform under surface has resilient palm pads for the user to aid in stabilizing the apparatus while in use. The base has a curved underside with padding and rests on the user's abdomen. A unitary embodiment is a rigid plate. A two-part embodiment has a foundation with a tray and a pedestal that sits in the tray. Optionally, the curved wings extend from sides of the base down around the sides of the user's abdomen. Pins in holes position the platform on top of the base. Optionally, a removable latch secures the platform to the base.

20 Claims, 5 Drawing Sheets

WEIGHT SUPPORT FOR ABDOMINAL EXERCISES

CROSS-REFERENCES TO RELATED APPLICATIONS

The applicant wishes to claim the benefit of U.S. Provisional Patent Application No. 60/228,298, dated Aug. 28, 2000 for ABBTRONICS in the name of Bradley G. Mayo.

STATEMENT REGARDING FEDERALLY SPONSORED RESEARCH OR DEVELOPMENT

Not Applicable

BACKGROUND OF THE INVENTION

1. Field of the Invention

This invention relates to exercise apparatus, and more particularly, to a device that positions and supports a weight on the abdomen for performing abdominal exercises.

2. Description of the Related Art

While the abdominal muscles seem to be a small part of a person's muscular system, they play an important role to our overall muscularity and strength. Abdominal muscle development is mostly determined by genetics and is the least receptive to exercise. The abdominal muscles are most severely stressed when attempting to "stabilize". This means that they respond to contraction, not movement.

There are a number of different methods for a person to perform abdominal exercises. However, all abdominal exercises are variations of the sit-up or leg raise. The abdominal muscles are stabilizing muscles with a limited range. They merely assist in pulling the trunk forward and in raising the legs upward. Thus, the movements involved in sit-ups, crunches, and leg raises are indirect. The muscles of the upper quadriceps are the primary movers in a leg raise. Sit-ups are better, but they are usually employed with so much momentum that the lower abdominal muscles are hardly working. The lower back tends to fatigue (due to the constant stretching) before the abdominal muscles get a good workout when doing high-rep sit-ups.

BRIEF SUMMARY OF THE INVENTION

An object of the present invention is to provide an apparatus to more efficiently exercise the abdominal muscles.

Another object is to provide an apparatus that can employ different types of weights.

The present invention is an apparatus for supporting a weight on a supine person's abdomen for performing abdominal exercises. The apparatus includes a base and a platform removably resting on the base. The base has a curved underside with padding and rests on the user's abdomen. The platform has a means for positioning and supporting one or more weights on its upper surface. The platform is positioned on top of the base by positioning pins in positioning holes.

The configuration of the platform depends upon the type of weight being used. There are two barbell configurations, one for a curl barbell configuration and the other for a straight barbell. Both have an elongated depression that extends completely across the platform. The depression for the curl barbell configuration is undulant and shaped to fit the central portion of the curl barbell. The depression for the straight barbell configuration is straight. The depression is deep enough so that the barbell does not slide out of the depression when the platform is in its normal horizontal operating position. A dumbbell platform configuration has pairs of interior depressions for receiving the weight ends of each dumbbell.

Alternatively to an elongated depression of the barbell configuration, projections from the platform surface, such as pegs, knobs, or bumps, may be used to position the barbell. Optionally, for the barbell configurations a pair of pegs may extend from the surface of the platform for maintaining the position of a stack of disc weights laid on top of the platform. Optionally, the bottom of the depressions may be textured to resist sliding by the weight. Optionally, the depressions may be lined with a resilient material to reduce damage. Optionally, the under surface of the platform may have resilient palm pads for the user to aid in stabilizing the apparatus while in use. Optionally, two or more configurations may be combined on a platform.

The base has a unitary embodiment and a two-part embodiment. The unitary embodiment is a plate composed of a rigid material. The preferably padded underside may be flat or contoured to better fit a user's abdomen. The two-part embodiment has a foundation with a tray and a pedestal that sits in the tray. Padding in the tray acts as a shock absorber between the foundation and pedestal during use.

Optionally, the base has curved wings extending from opposite sides thereof and down around the sides of the user's abdomen in order to provide stability for the apparatus during use.

The platform is maintained in the desired position on the base by pins in holes. The pins may be on the base, platform, or both and the holes located opposite the pins.

Optionally, a removable latch may be used to secure the platform to the base. Examples include a shaped tab that fits into an aperture, a threaded screw, and a quarter-turn latch.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
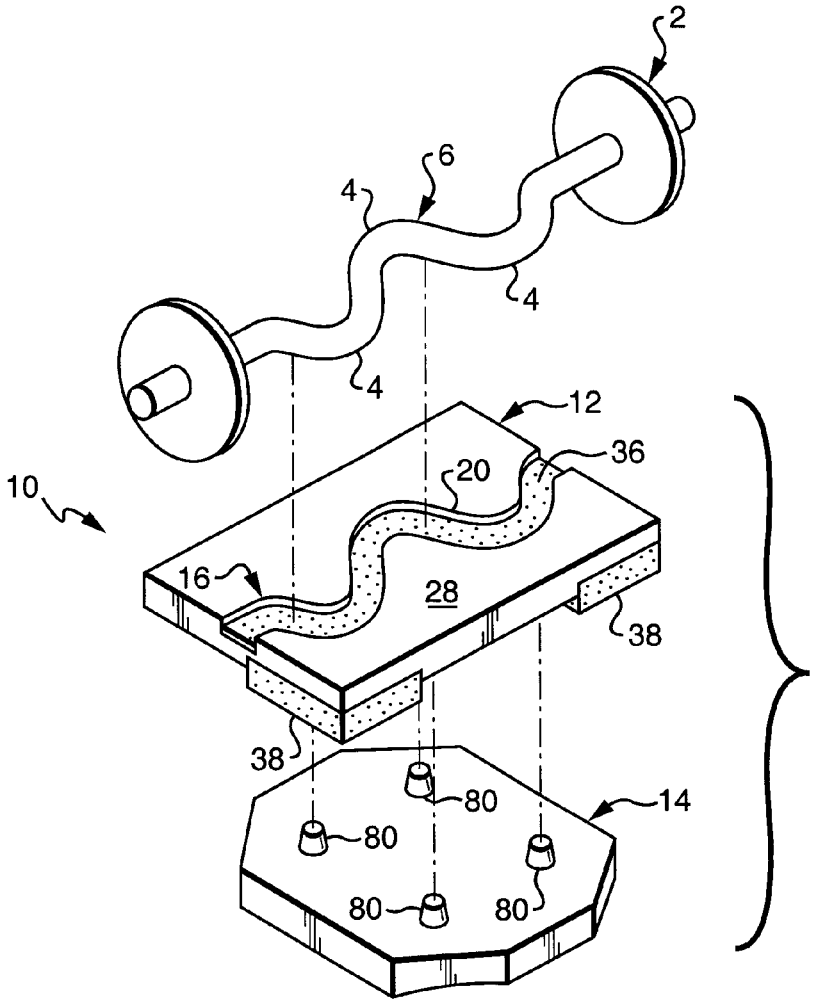
FIG. 1 is a perspective, exploded view of a configuration of the present invention for use with a curl barbell.
Figure 2:
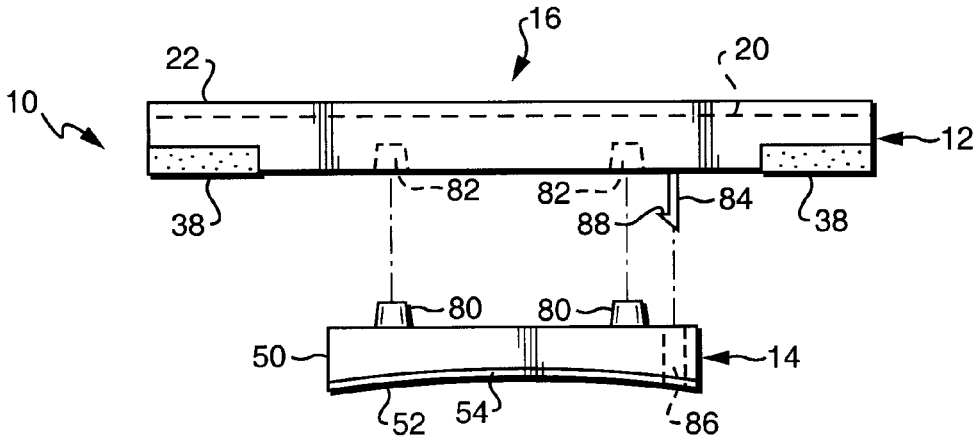
FIG. 2 is a phantom, side view of the configuration of FIG. 1.

The present invention is an apparatus for comfortably supporting a weight barbell or dumbbells on a supine person's abdomen for performing abdominal exercises. As shown in FIGS. 1 and 2, the present invention 10 has a platform 12 and a base 14. The platform 12 supports the weight and positions the weight so that it is held relatively stable. The base 14 rests on the user's abdomen and supports the platform 12.

The platform 12 has several configurations. The configuration depends upon the type of weight being used. There are two barbell configurations, one for a curl barbell and one for a straight barbell. The curl barbell configuration, shown in FIG. 1, is for use with a standard curl barbell 2. The curl barbell 2 is not straight. It has a number of curves 4 so that, when being used for curls, the user can hold the barbell 2 horizontally without have the forearms twisted uncomfortably. The platform curl barbell configuration has a channel 16 in the form of an elongated, undulant depression 20 in the upper surface 28 that is shaped to fit the central portion 6 of the curl barbell 2. The undulant depression 20 extends completely across the platform 12 and is deep enough so that the curl barbell 2 does not slide out of the depression 20 when the platform 12 is in its normal operating position, that is, approximately horizontal.

Figure 3:
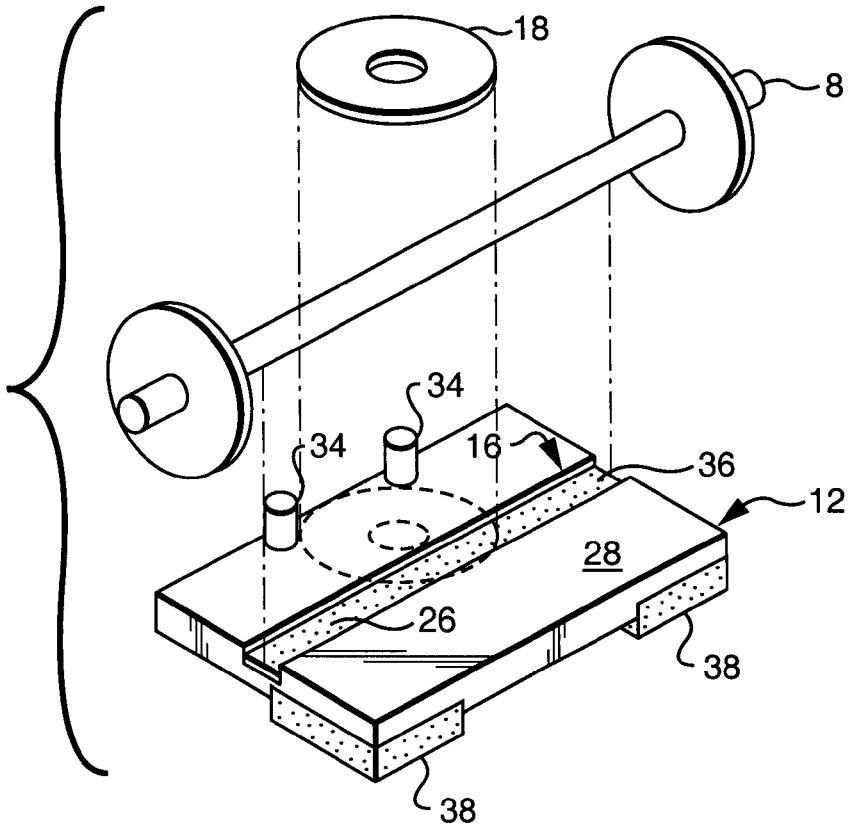
FIG. 3 is a perspective view of a platform showing the straight barbell groove configuration and the optional configuration for extra weight discs.

Another weight platform configuration, the straight barbell configuration, is shown in FIG. 3. It is for use with a straight barbell. The platform straight barbell configuration has a channel 16 in the form of an elongated, straight depression 26 in the upper surface 28. The straight depression 26 extends completely across the platform 12 and is deep enough so that the straight barbell 8 does not slide out of the depression 26 when the platform 12 is in its approximately horizontal normal operating position. The straight depression 26 should be narrow enough so that rolling by the straight barbell 8 within the depression 26 is minimized.

Optionally for the curl and straight barbell configurations, a pair of pegs 34 may extend from the surface of the platform 12. The purpose of the pegs 34 is to maintain the position of a stack of one or more disc weights 18 laid horizontally on top of the depression 26, as in FIG. 3. The pegs 34 prevent the disc weights 18 from sliding off the platform 12. In addition, the disc weights 18 help hold the barbell 8 within the depression 26.

Figure 4:
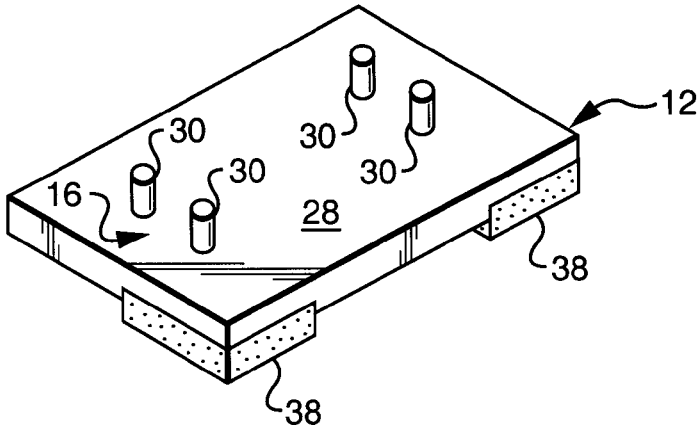
FIG. 4 is a perspective view of a platform showing the straight barbell protrusion configuration.

Alternatively for the curl and straight barbell configurations, the channel 16 may be formed by projections 30 from the surface 28 of the platform 12, as shown in FIG. 4. The projections 30 may be pegs, knobs, bumps, or other such protrusions. The projections 30 are high enough to prevent the barbell from rolling over them and are sturdy enough so that the barbell does not bend or otherwise warp the projections 30 to the point where the barbell is in danger of coming out of the channel 16. The projections 30 may be molded into the platform 12 or permanently attached to the platform 12.

Figure 5:
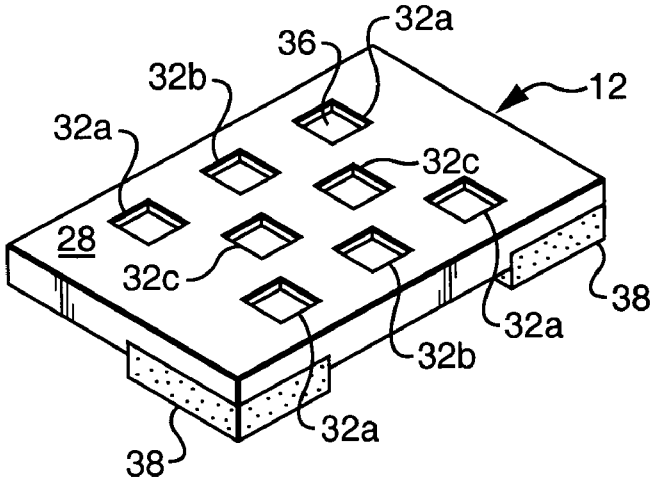
FIG. 5 is a perspective view of a platform configured for dumbbells.

Another platform configuration, the dumbbell configuration, is shown in FIG. 5. This configuration is for use with a dumbbell or pair of dumbbells. The upper surface 28 has pairs of interior depressions 32*a*, 32*b*, 32*c* (collectively, 32) for receiving the weight ends of each dumbbell. The present invention contemplates any practical location for the depressions 32. For example, there may be four pairs of depressions 32, as in FIG. 5. The two outside pairs 32*a* are for pairs of dumbbells of equal weight (so that balance is maintained). The center pair 32*b* parallel with the outside pairs 32*a* is for a single dumbbell and the center pair 32*c* perpendicular to the outside pairs 32*a* is for a single dumbbell.

The present invention contemplates that some or all of these various configurations may be combined into a single platform 12. For example, the straight barbell and dumbbell configurations may be combined by putting both interior depressions 32 and a straight depression 26 in a single platform 12.

The present invention contemplates several optional enhancements to the platform 12. First, the bottom of the depressions may be textured to resist sliding by the weight as the user exercises. Second, the depressions may be lined with a resilient material 36 to reduce damage to the weight platform 12 and/or the weight, and to act as a shock absorber for when the weight is placed on the platform 12. Third, there may be resilient palm pads 38 on the under surface of the platform 12 for the user to aid in stabilizing the apparatus 10 while in use.

The base 14 rests on the user's abdomen and supports the platform 12. There are two basic embodiments of the base 14, a unitary embodiment and a two-part embodiment. The unitary embodiment is shown in FIGS. 1 and 2. It is a plate 50 composed of a rigid material, such as wood, plastic, or metal. The underside 52 may be flat or it may be slightly concave, as in FIG. 2, to better contour to the user's abdomen. Preferably, the underside 52 includes padding 54 for comfort.

Figure 6:
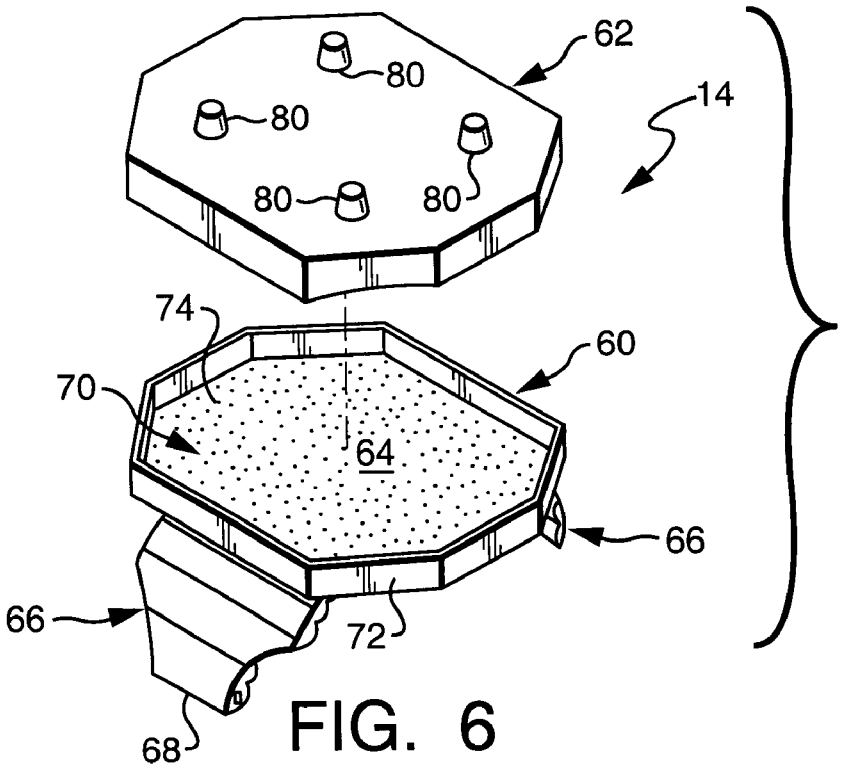
FIG. 6 is a perspective view of the two-part configuration of the base.
Figure 7:
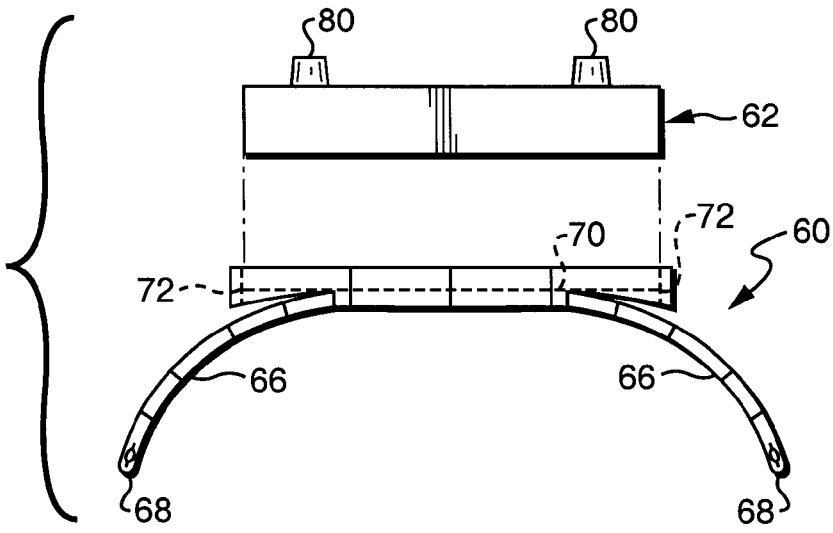
FIG. 7 is an exploded, side view of the two-part base of FIG. 6.
Figure 8:
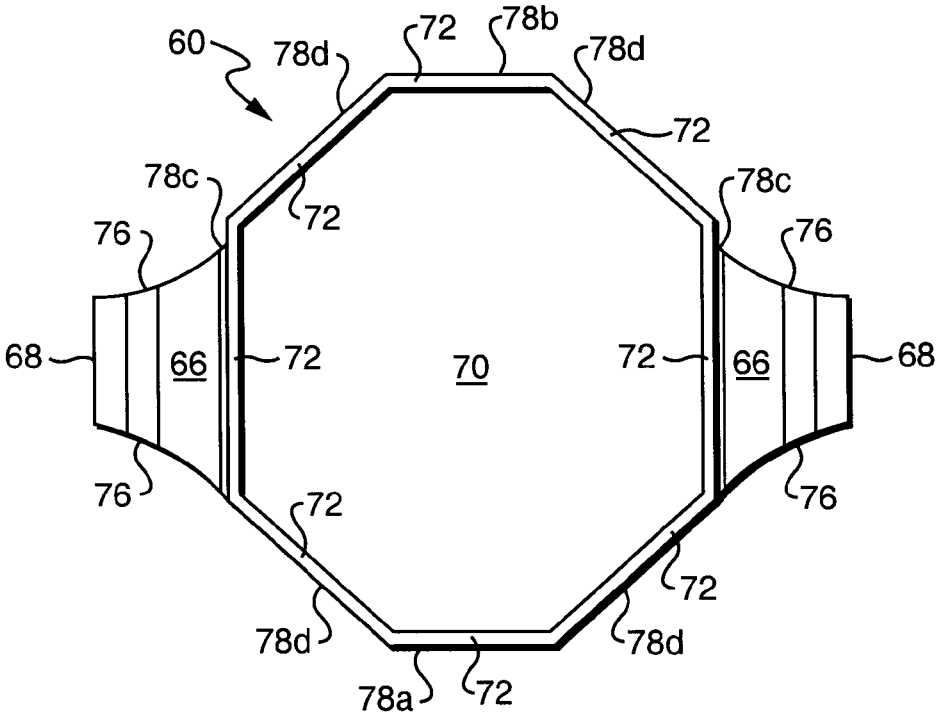
FIG. 8 is a top view of the foundation of FIG. 6.

The two-part embodiment is shown in FIGS. 6–8. It has a foundation 60 and a pedestal 62. The foundation 60 has a tray 70 formed by walls 72 that extend completely around the perimeter. The floor of the tray 70 is covered with padding 74, the purpose of which is to act as a shock absorber for the pedestal 62. The pedestal 62 sits in the tray 70 on the padding 74 and has substantially the same perimeter shape as the inside of the tray 70 to prevent unwanted motion of the pedestal 62 within the tray 70.

The base 14 is shaped to comfortably rest on the user's abdomen. In the current implementation, the base 14 is octagonal. The near side 78*a* is adjacent to the user's ribs and is relatively narrow. The far side 78*b* is wider and is adjacent to the user's pelvis. The left and right sides 78*c* are relatively longer. These four sides are connected by four angled sides 78*d*. The terms near, far, left and right are used merely for orientation purposes and are relative the user's head.

Optionally, the base 14 has curved wings 66 extending from opposite sides thereof. The wings 66 provide stability for the apparatus by extending down around the sides of the user's abdomen. The wings 66 become narrow toward the ends 68, as at 76, so that the wings 66 do not overlap the user's pelvis. The wings 66 may be rigid so that they have fixed shape or they may be flexible to conform to the user.

The platform 12 rests on top of the base 14. Preferably, the platform 12 is maintained in the desired position on the base 14 by pins 80 extending from the upper surface of the base 14 into holes 82 in the underside of the platform 12. There must be at least two pin-hole pairs to prevent the platform 12 from moving relative to the base 14. The platform 12 is installed on the base 14 by aligning the holes 82 with the pins 80 and lowering the platform 12 onto the base 14. Alternatively, the pins 80 are on the platform and holes 82 on the base, or a combination thereof.

Optionally, the present invention contemplates that a latch may be used to secure the platform 12 to the base 14. The present invention contemplates than any form of removable latch may be employed. Several examples are shown in the figures. FIG. 2 illustrates a shaped tab 84 extending from the undersurface of the platform 12 into an aperture 86 in the base 14. The tab 84 deforms as it enters the aperture 86 and then snaps back to it normal shape as the head of the tab 84 clears the aperture 86. A flat surface 88 on the head of the tab 84 abuts the undersurface 52 of the base 14, preventing the platform 12 from being inadvertently removed. The platform 12 is removed by manually deforming the tab 84 and lifting the platform 12 from the base 14.

Figure 9:
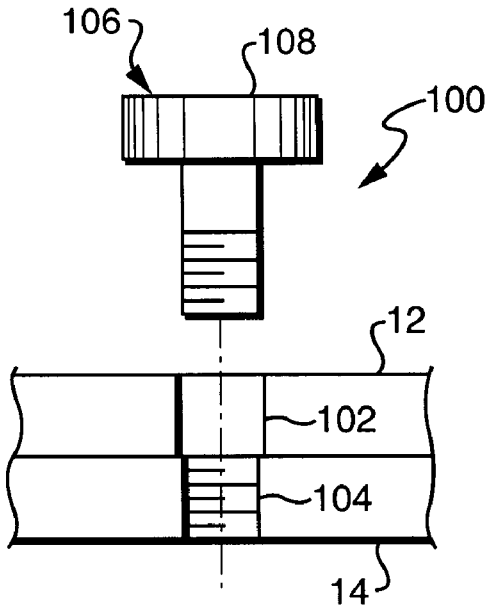
FIG. 9 is a cross-section view of a threaded screw latch.

FIG. 9 illustrates a threaded screw latch 100. There is a hole 102 in the platform 12 and a threaded hole 104 in the base 14. A screw 106 extends through the platform hole 102 and is turned into the base hole 104. The screw 106 has a knurled head 108 for grasping by the user's fingers.

Figure 10:
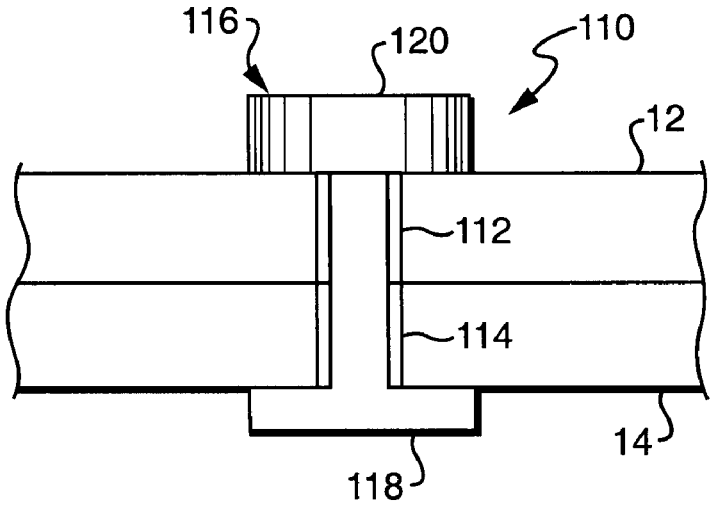
FIG. 10 is a cross-section view of a quarter turn latch.

FIG. 10 illustrates a quarter-turn latch 110. There is a through slot 112 in the platform 12 and a through slot 114 in the base 14. The T-shaped lock 116 is inserted through both slots 112, 114 and turned a quarter rotation so that the lock cross bar 118 cannot be pulled back through the slots 112, 114, preventing the lock 116 from being removed and securing the platform 12 to the base 14. The lock 116 has a knurled head 120 for grasping by the user's fingers.

Thus it has been shown and described a weight support for abdominal exercises which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. An apparatus adapted to support weight on the abdomen of a supine person during abdominal exercises, said apparatus comprising:

(a) a base and a platform removably resting on said base;

(b) said base having a curved underside with padding and adapted to rest on said abdomen;

(c) said platform having a means for positioning and supporting one or more weights on an upper surface of said platform; and (d) said platform being positioned on top of said base by positioning pins in positioning holes.

2. The apparatus of claim 1 wherein said means for positioning and supporting said weights includes at least one depression on said platform upper surface.

3. The apparatus of claim 2 wherein one of said at least one depression extends completely across said platform upper surface and is adapted to receive a barbell.

4. The apparatus of claim 2 wherein said at least one depression includes at least a pair of depressions adapted to receive the weighted ends of a dumbbell.

5. The apparatus of claim 2 wherein pegs adapted to position horizontal disc weights extend from said platform upper surface.

6. The apparatus of claim 1 wherein said means for positioning and supporting said weights includes a plurality of projections extending from said platform upper surface.

7. The apparatus of claim 1 wherein said positioning pins extend from an upper surface of said base into said positioning holes in a lower surface of said platform.

8. The apparatus of claim 1 wherein said positioning pins extend from a lower surface of said platform into said positioning holes in an upper surface of said base.

9. The apparatus of claim 1 wherein a latch removably secures said platform to said base.

10. The apparatus of claim 1 wherein said platform includes palm pads on an under surface.

11. The apparatus of claim 1 wherein said base includes wings extending from sides thereof and adapted to extend down the sides of said person's abdomen.

12. The apparatus of claim 1 wherein said base is a rigid plate.

13. The apparatus of claim 1 wherein said base includes a foundation and a pedestal, said pedestal removably positioned in a tray in an upper surface of said foundation and said platform positioned on top of said pedestal.

14. An apparatus adapted to support weight on the abdomen of a supine person during abdominal exercises, said apparatus comprising:

(a) a base and a platform removably resting on said base;

(b) said base having a curved underside with padding and adapted to rest on said abdomen;

(c) said platform having an upper surface with at least one depression adapted for positioning and supporting one or more weights;

(d) said platform upper surface having pegs adapted to position horizontal disc weights;

(e) said platform having an under surface with palm pads; and (f) said platform being positioned on top of said base by positioning pins in positioning holes.

15. The apparatus of claim 14 wherein one of said at least one depression extends completely across said platform upper surface and is adapted to receive a barbell.

16. The apparatus of claim 14 wherein said at least one depression includes at least a pair of depressions adapted to receive the weighted ends of a dumbbell.

17. The apparatus of claim 14 wherein a latch removably secures said platform to said base.

18. The apparatus of claim 14 wherein said base includes wings extending from sides thereof and adapted to extend down the sides of said person's abdomen.

19. The apparatus of claim 14 wherein said base is a rigid plate.

20. The apparatus of claim 14 wherein said base includes a foundation and a pedestal, said pedestal removably positioned in a tray in an upper surface of said foundation and said platform positioned on top of said pedestal.

* * * * *